US010385858B2

(12) United States Patent
Haddad

(10) Patent No.: US 10,385,858 B2
(45) Date of Patent: Aug. 20, 2019

(54) ENERGY-GENERATING PUMP

(71) Applicant: Joseph C. Haddad, Elizabethtown, PA (US)

(72) Inventor: Joseph C. Haddad, Elizabethtown, PA (US)

( * ) Notice: Subject to any disclaimer, the term of this patent is extended or adjusted under 35 U.S.C. 154(b) by 473 days.

(21) Appl. No.: 15/194,126

(22) Filed: Jun. 27, 2016

(65) Prior Publication Data

US 2016/0377045 A1 Dec. 29, 2016

Related U.S. Application Data

(60) Provisional application No. 62/184,747, filed on Jun. 25, 2015.

(51) Int. Cl.

| | |
|---|---|
| ***F03B 17/04*** | (2006.01) |
| ***F04D 15/00*** | (2006.01) |
| ***F03B 17/00*** | (2006.01) |

(52) U.S. Cl.

CPC ..... *F04D 15/0066* (2013.01); *F03B 17/005* (2013.01); *F05B 2210/00* (2013.01); *F05B 2210/13* (2013.01); *F05B 2210/404* (2013.01)

(58) Field of Classification Search

USPC ..... 415/916; 290/1 R

See application file for complete search history.

(56) References Cited

U.S. PATENT DOCUMENTS 2,911,917 A 11/1959 Hardy
3,803,422 A * 4/1974 Krickler ..... F03B 13/00 290/1 R
6,644,937 B2 * 11/2003 Han ..... F04B 9/113 415/916
6,772,592 B2 * 8/2004 Gerber ..... F03B 13/1845 290/53
7,579,701 B1 * 8/2009 White ..... F03D 3/002 290/1 R
7,955,058 B1 6/2011 Angel
(Continued)

OTHER PUBLICATIONS

International Search Report dated Feb. 3, 2017 for Application Serial No. PCT/US16/63614.

(Continued)

*Primary Examiner* — Jason D Shanske
*Assistant Examiner* — Brian Christopher Delrue
(74) *Attorney, Agent, or Firm* — F. Chau & Associates, LLC

(57) ABSTRACT

A pumping apparatus includes a container positioned over a left column and a right column that contains a first fluid, left and right intake valves that respectively connect the left and right columns to the container, left and right pumps respectively associated with the left and right columns, upper and lower connecting pipes that connect the left and right columns below the container, a plurality of gates positioned at entrances of the upper and lower connecting pipes in each of the left and right columns, a turbine positioned to be driven by fluid flowing through the upper and lower connecting pipes, and a third fluid disposed in the upper and lower connecting pipes, and the left column and a right column. The turbine generates electric power due to the flow of the third fluid through the left and right columns and the upper and lower connecting pipes.

1 Claim, 5 Drawing Sheets

(56) References Cited

U.S. PATENT DOCUMENTS 8,024,927 B1* 9/2011 Azizi ..... F03B 17/02 290/1 R
8,844,277 B2* 9/2014 Fong ..... F01K 25/06 60/408
2009/0072545 A1* 3/2009 Van Michaels ..... F03G 6/00 290/1 A
2009/0160193 A1 6/2009 Farm
2009/0193799 A1* 8/2009 LeBlanc ..... F03B 17/025 60/325
2009/0196769 A1 8/2009 Davis, Sr.
2010/0072754 A1* 3/2010 Huang ..... F03B 17/005 290/54
2010/0084866 A1* 4/2010 Smith ..... F03B 17/04 290/52
2010/0133903 A1* 6/2010 Rufer ..... F02C 6/16 307/22
2010/0207394 A1* 8/2010 Leung ..... E02B 9/00 290/54
2010/0283261 A1* 11/2010 Ryan ..... F03B 17/04 290/1 R
2011/0074163 A1* 3/2011 Timcang, Sr. ..... F03B 17/005 290/1 R
2011/0095543 A1* 4/2011 Filho ..... H02K 53/00 290/1 R
2011/0204627 A1* 8/2011 Ho ..... F03B 17/005 290/43
2011/0204645 A1* 8/2011 Jacobson ..... F03B 13/08 290/54
2012/0112471 A1 5/2012 Karoglan
2013/0043684 A1* 2/2013 Shinohara ..... F03B 17/025 290/54
2013/0187386 A1* 7/2013 Nanayakkara ..... H02K 7/1823 290/52
2013/0307272 A1* 11/2013 Smith ..... F01D 15/10 290/50
2014/0312623 A1* 10/2014 Anteau ..... F03B 17/005 290/52
2014/0375059 A1* 12/2014 Letang ..... F03B 13/00 290/54
2015/0028596 A1 1/2015 Hung
2015/0198057 A1* 7/2015 Hanna ..... F01D 15/10 290/52
2016/0194126 A1 7/2016 Findlay
2016/0201643 A1* 7/2016 Blake ..... H02K 53/00 290/50

OTHER PUBLICATIONS

Notification Concerning Transmittal of International Preliminary Report on Patentability dated Jan. 10, 2019 for Application No. PCT/US2016/063614.

* cited by examiner

ENERGY-GENERATING PUMP

CROSS REFERENCE TO RELATED UNITED STATES APPLICATIONS

This application claims priority from U.S. Provisional Application No. 62/184,747, of Joseph C. Haddad, filed in the U.S. Patent and Trademark Office on Jun. 25, 2015.

TECHNICAL FIELD

Embodiments of the present disclosure are directed to a pump that can extract energy inherent in air pressure due to the gravitational pull on the Earth's atmosphere.

SUMMARY

According to an embodiment of the disclosure, there is provided a pumping apparatus that includes a container positioned over a left column and a right column that contains at least a first fluid, wherein the container includes a reflective wall at a left end and a reflective wall at a right end, a left intake valve and a right intake valve that respectively connect the left column and the right column to the container, a left pump and a right pump respectively associated with the left column and the right column, upper and lower connecting pipes that connect the left column and the right column below the container, a plurality of one-way gates, each positioned at an entrances of one of the upper and lower connecting pipes in each of the left and right columns, a main turbine positioned to be driven by fluid flowing through the upper and lower connecting pipes, a left auxiliary turbine and a right auxiliary turbine respectively disposed in the left and right columns, a third fluid disposed in the upper and lower connecting pipes, and the left column and a right column, wherein main turbine and the left and right auxiliary turbines generate electric power due to the flow of the third fluid through the left and right columns and the upper and lower connecting pipes.

According to a further embodiment of the disclosure, the main turbine and the left and right auxiliary turbines include flywheels.

According to a further embodiment of the disclosure, the container includes operable ports in a side wall and a top of the container, wherein placement of the ports is determined to optimize flow of the fluid in the container.

According to a further embodiment of the disclosure, each pump is a variable speed pump.

According to a further embodiment of the disclosure, the container contains a second fluid, wherein the first and second fluids are stratified with the first fluid above the second fluid.

According to a further embodiment of the disclosure, the first fluid and the second fluid are gases of different densities, and the third fluid is a liquid.

According to a further embodiment of the disclosure, the first fluid and the second fluid are liquids that are immiscible and incompressible.

According to a further embodiment of the disclosure, the apparatus a flexible bladder between the first fluid and the second fluid.

According to another embodiment of the disclosure, there is provided a method of operating a pumping apparatus, including pumping a first fluid from a top of a left column through an open right intake valve into a container, and opening lower gates of a connecting pipe that connects the left column to a right column, wherein a vacuum is created in the left column that pulls up a third fluid in the left column, which flows across lower turbine blades of a main turbine in the connecting pipe, stopping pumping in the left column, closing the right intake valve and the lower gates, wherein the first fluid in the container moves toward a right reflective wall of the container, pumping the first fluid from a top of the right column toward an open left intake valve and opining and upper gates of the connecting pipe, wherein a vacuum is created in the right column that pulls up the third fluid, and the third fluid flows across upper turbine blades of the main turbine, stopping pumping in the right column, closing left intake valve and the upper gates, wherein the first fluid in the container moves toward the left reflective wall of the container, and pumping the first fluid from the top of the left column toward the open right intake valve and opening the lower gates, wherein a vacuum is created in the left column that pulls up the third fluid, and the third fluid flows across lower turbine blades of the main turbine.

DETAILED DESCRIPTION

Figure 1:
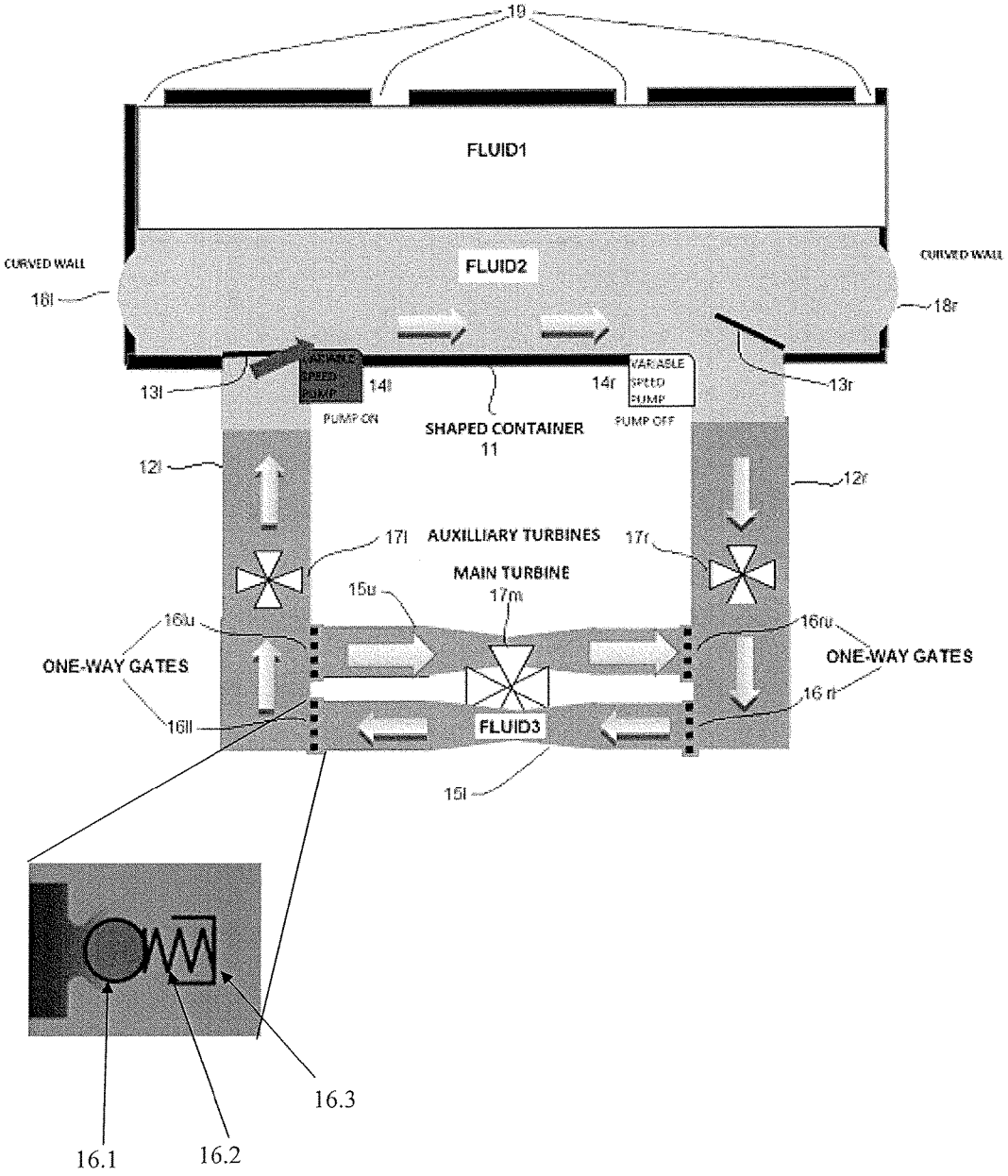
FIG. 1 is a cross-sectional view of a pump according to an embodiment of the disclosure in State 1.

Exemplary embodiments of the disclosure as described herein generally include pumps that can extract energy inherent in air pressure due to the gravitational pull on the Earth's atmosphere. Accordingly, while the disclosure is susceptible to various modifications and alternative forms, specific embodiments thereof are shown by way of example in the drawings and will herein be described in detail. It should be understood, however, that there is no intent to limit the disclosure to the particular forms disclosed, but on the contrary, the disclosure is to cover all modifications, equivalents, and alternatives falling within the spirit and scope of the disclosure. With regard to the drawing figures, like reference numerals may designate like elements having the same configuration. In addition, relative dimensions and ratios of portions in the drawings may be exaggerated or reduced in size for clarity and convenience in the drawings, and any dimension are exemplary and non-limiting.

Referring to FIG. 1, a pump apparatus 10 according to an embodiment of the disclosure includes a shaped container 11 positioned over two fluid columns, in particular a left column 12*l* and a right column 12*r*. The shaped container has a left reflective wall 18*l* at a left end, and a right reflective wall 18*r* at a right end. The left column and the right columns 12*l*, 12*r* are connected to the shaped container 11 by a left intake valve 13*l* and a right intake valve 13*r*, respectively. A variable speed pump 14*l*, 14*r* is associated with each of the left and right columns. The shaped container 11 may contain a first fluid Fluid 1, or may contain stratified first and second fluids Fluid 1, Fluid 2. Note that although FIG. 1 shows Fluid 1 as being disposed above Fluid 2, this configuration is exemplary and non-limiting and Fluid 2 may be disposed above Fluid 1 in other embodiments. An incompressible third fluid Fluid 3 is disposed in the left and right columns 12*l*, 12*r*. The left and right columns 12*l*, 12*r* are connected below the shaped container by upper and lower connecting pipes 15*u*, 15*l*. One-way gates 16*lu*, 16*ll*, 16*ru*, 16*rl* are positioned at the entrances of the upper and lower connecting pipes in each of the left and right columns to control a direction of fluid flow of Fluid 3 through the upper and lower connecting pipes 15*u*, 15*l*. An enlarged view of a one-way gate according to an embodiment is shown at the lower left of FIG. 1. A one-way gate according to an embodiment includes a ball 16.1 on a spring 16.2 that is mounted on a stop 16.3. Fluid flow against the ball 16.1 pushed the ball against the spring 16.2, which compresses to permit fluid flow when fluid pressure on the ball exceeds the outward force of the spring. A main turbine 17*m* is positioned to be driven by fluid flowing through the upper and lower connecting pipes 15*u*, 15*l*, and a left auxiliary turbine 17*l* and a right auxiliary turbine 17*r* are respectively disposed in the left and right columns 12*l*, 12*r*. The main turbine 17*m* and the left and right auxiliary turbines 17*l*, 17*r* can generate electric power due to the flow of the third fluid Fluid 3 through the left and right columns 12*l*, 12*r*, and the upper and lower connecting pipes 15*u*, 15*l*. In some embodiments, the turbines may use flywheels for improved efficiency. The shaped container 11, the left and right columns 12*l*, 12*r*, and the upper and lower connecting pipes 15*u*, 15*l* may be fabricated from any suitable material, such as steel, plastic, or reinforced concrete.

An operation of an apparatus according to an embodiment of the disclosure includes 5 states, herein referred to as State 1, . . . , State 5, of which States 2 to 5 are cyclically repeated. States 1 to 5 are described with respect to FIGS. 1-5, below.

State 1: State 1 is a startup state, with no established air current in the shaped container 11. Referring now to FIG. 1, the left pump 14*l* directs Fluid 2 from top of the left column 12*l* toward the open intake valve 13*l* on the right side. A vacuum is created in the left column 12*l* that pulls Fluid 3 up. The lower gates 16*ll*, 16*rl* are open to allow flow of Fluid 3 across the lower turbine blades of the main turbine 17*m*.

Figure 2:
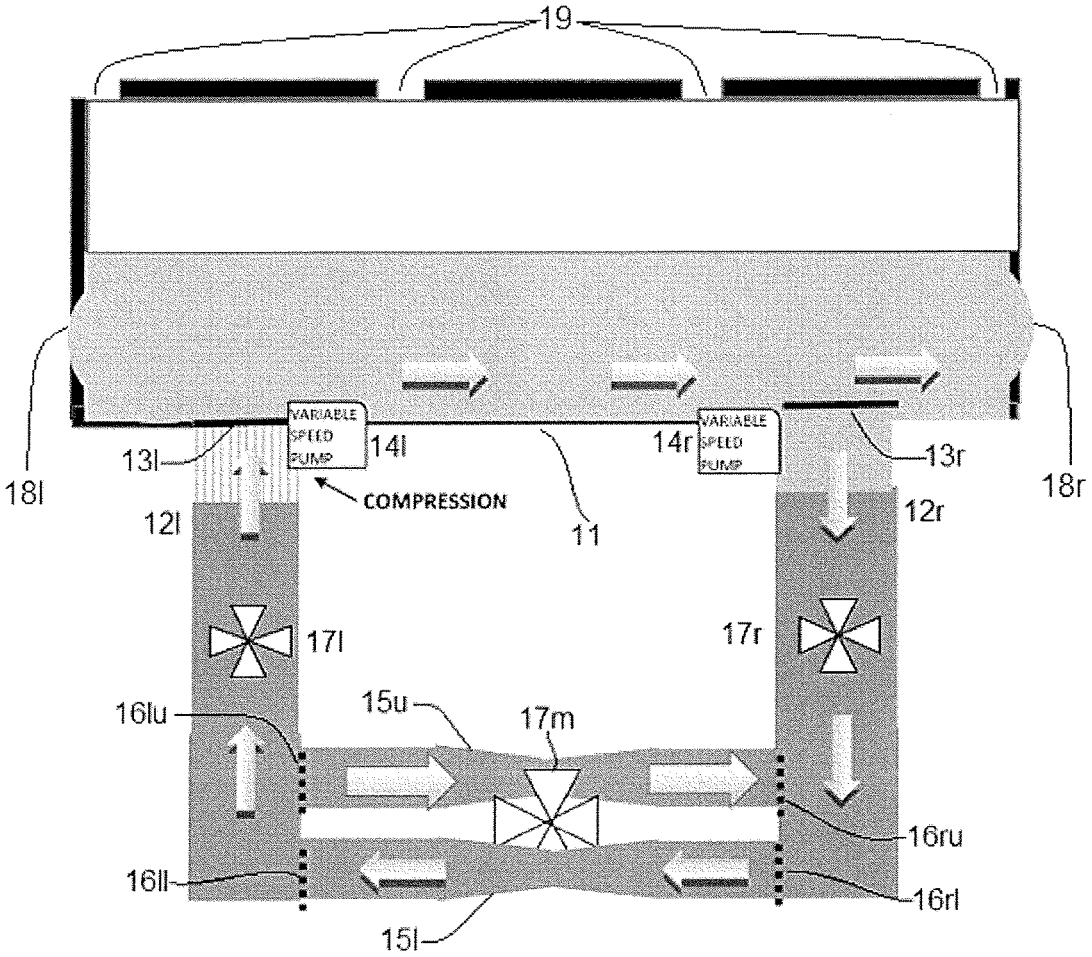
FIG. 2 is a cross-sectional view of a pump according to an embodiment of the disclosure in State 2.

State 2: Referring now to FIG. 2, the left pump 14*l* stops, and the intake valve 13*r* on the right side closes. Compression of Fluid 2 at the top of the left column 12*l* acts as a surge drum to capture energy from the moving Fluid 3. The lower gates 16*ll*, 16*rl* close. The movement of Fluid 2 in the container 11 is toward the right reflective wall 18*r*.

Figure 3:
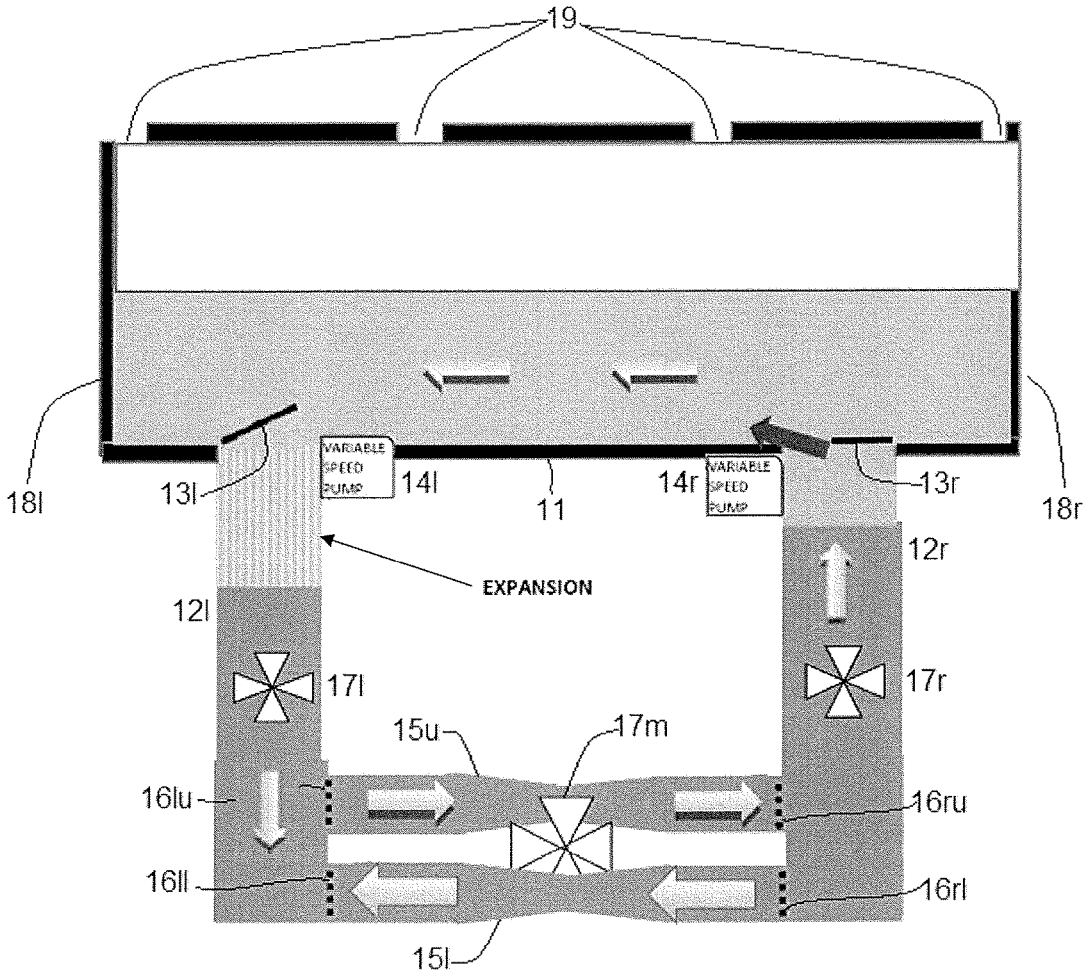
FIG. 3 is a cross-sectional view of a pump according to an embodiment of the disclosure in State 3.

State 3: Referring now to FIG. 3, the right pump 14*r* directs Fluid 2 from the top of the right column 12*r* toward the open intake valve 13*l* on the left side. The timing of the start of the right pump 14*r* and the opening of the left intake valve 13*l* should be set to maximize the push from the right reflective wall 18*r* to maximize the creation of a seiche. The distance from the right intake valve 13*r* to the right reflective wall 18*r* should be set to optimize a timing sequence. A vacuum is created in the right column 12*r* that pulls Fluid 3 up. The upper gates 16*lu*, 16*ru* open to allow Fluid 3 to flow across the upper turbine blades of the main turbine 17*m*. Valves 13*l*, 13*r* in the container at the top of the left and right columns 12*l*, 12*r* are opened/closed to maximize the directional push.

Figure 4:
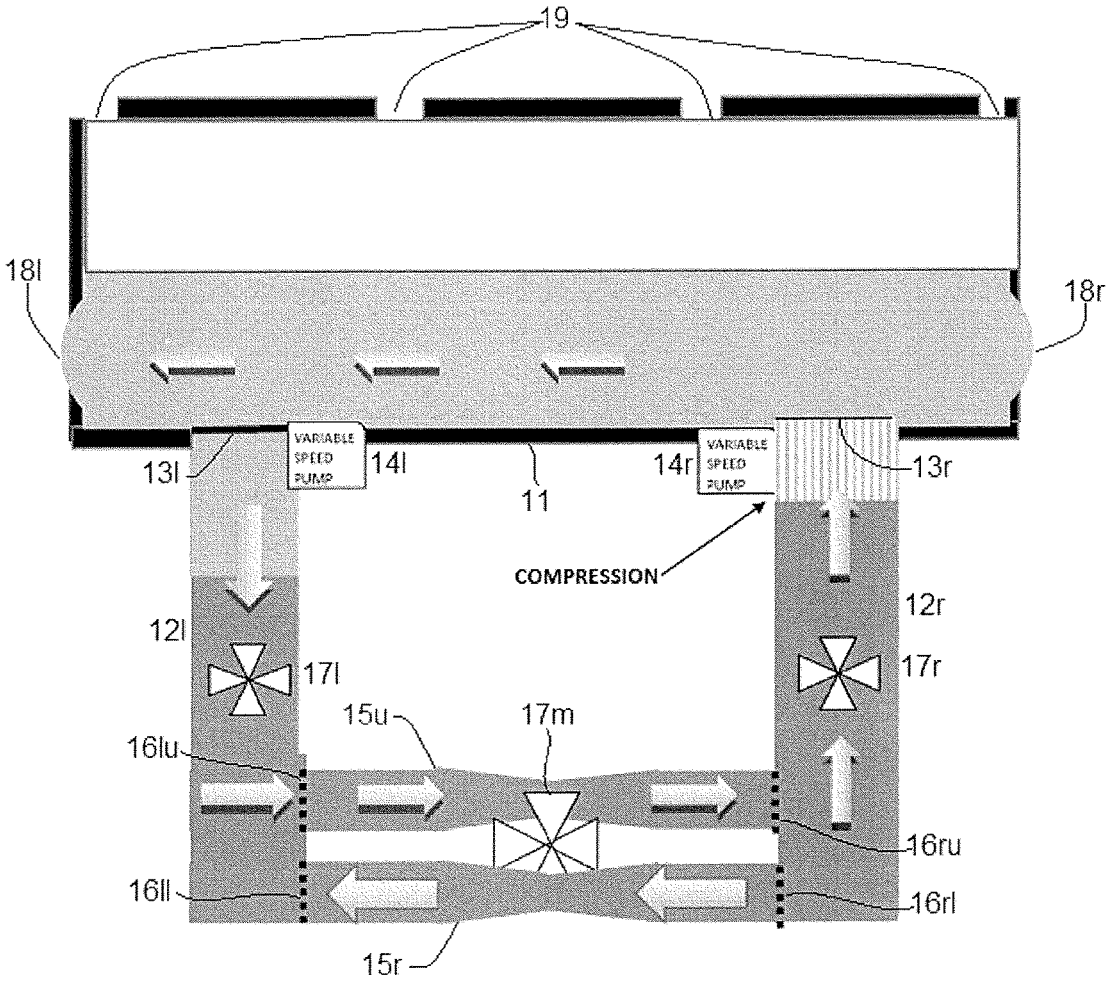
FIG. 4 is a cross-sectional view of a pump according to an embodiment of the disclosure in State 4.

State 4: Referring now to FIG. 4, the right pump 14*r* stops, and the intake valve 13*l* on the left side closes. Compression of Fluid 2 at the top of the right column 12*r* acts as a surge drum to capture energy from moving Fluid 3. The upper gates 16*lu*, 16*ru* close. The movement of Fluid 2 in the container 11 is toward the left reflective wall 18*l*.

Figure 5:
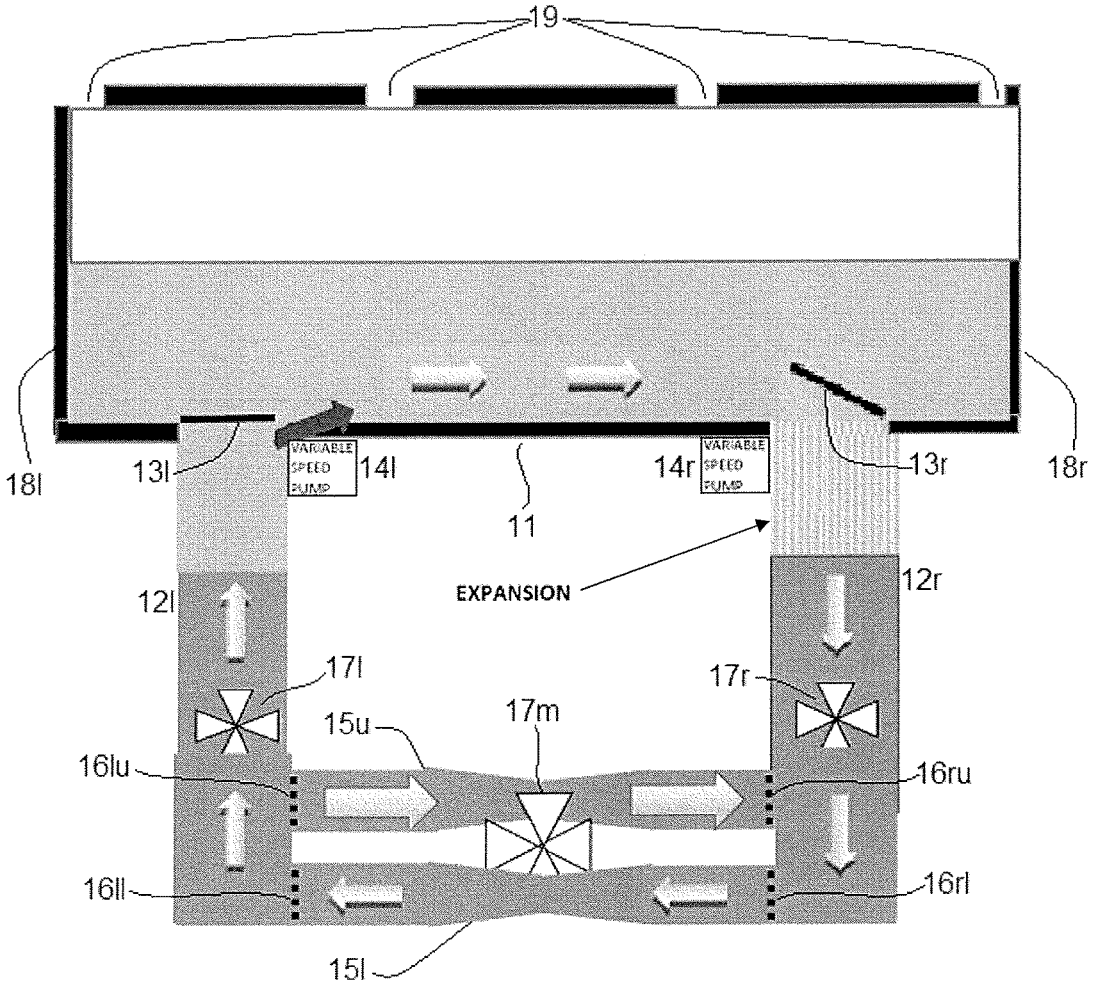
FIG. 5 is a cross-sectional view of a pump according to an embodiment of the disclosure in State 5.

State 5: Referring now to FIG. 5, the left pump 14*l* directs Fluid 2 from the top of the left column 12*l* toward the open intake valve 13*r* on the right side. The timing of the start of the left pump 14*l* and the opening of the right intake valve 13*r* should be set to maximize the push from the left reflective wall 18*l*. The distance from the left intake valve 13*l* to the left reflective wall 18*l* should be set to optimize the timing sequence. Creation of vacuum in left column 12*l* pulls Fluid 3 up. Lower gates 16*ll*, 16*rl* are open to allow flow of Fluid 3 across lower turbine blades of the main turbine 17*m*. Valves 13*l*, 13*r* in the container at the top of the left and right columns 12*l*, 12*r* are opened/closed to maximize directional push. Although the pump, valve and gate configurations of State 5 are similar to those of State 1, State 5 can be further characterized by fluid currents in the shaped container 11 that facilitate the pumping process by reducing the amount of energy required by the pumps 14*l*, 14*r* to exhaust Fluid 2 from the columns 12*l*, 12*r*.

The Fluid 3 movement is based on the action of a hydraulic ram. Fluid 3 is set in motion by the creation of temporary vacuums at the tops of the left and right columns 12*l*, 12*r*. Speed of the pumps 14*l*, 14*r* at the top of each column 12*l*, 12*r* is determined by an optimal balance of electricity expended and power created. Unlike the liquid exiting from the bottom of a filled soda straw, which depends on the pull of gravity alone, the movement of Fluid 3 in the two columns 12*l*, 12*r* is augmented by a "free" constant push of atmospheric pressure against a vacuum in the opposite column.

Closing the pumps 14*l*, 14*r* in states 2 and 4 causes the creation of "fluid hammer". The energy of the fluid hammer is captured by the compression of Fluid 2 at the top of the columns 12*l*, 12*r*. The height of the columns 12*l*, 12*r*, the amount of Fluid 2, and the amount of Fluid 3 can be optimized to capture a maximum amount of energy.

Closing the pumps 14*l*, 14*r* also causes the remaining energy in Fluid 2 in the container 11 to create a seiche that pushes into the corresponding reflective wall. A return of this energy toward the opposite wall creates a region behind it of reduced pressure, into which the pumps 14*l*, 14*r* can direct air flow. In other embodiments, the container includes ports 19 in the side walls and roof that can be opened or closed to allow an inflow of air from the top or the side walls that may augment the movement of Fluid 2 toward the opposing wall.

The placement and the opening/closing of ports in the container can manipulate pressure to create a micro-climate to maximize push. If an apparatus according to an embodiment of the disclosure can develop distinct masses of air at varying pressures that move in a predictable pattern, then a timing sequence can be developed and optimized to exploit the high/low air pressures during the intake and exhaust of Fluid 2 from the columns 12*l*, 12*r*. According to further embodiments of the disclosure, baffles may be disposed in the shaped container to direct the circulating fluid masses and to increase/decrease their velocities at several points in the shaped container. For example, using a funnel to speed up a circulating fluid mass in the container at the point where a pump is exhausting fluid into the container may provide a fluid mass of lower pressure as an exhaust target for the pump. According to further embodiments of the disclosure, by using ports on the walls and roof of the shaped container, an apparatus according to an embodiment of the disclosure can also use the pressure of the ambient air outside the container to increase/decrease pressures in the container at advantageous points.

The use of a fluid, such as a gas, heavier than air (Fluid 2 vs. Fluid 1) is based on the assumption that a stratified body of gases in the container will concentrate the seiche in the lower portion of the vessel. In some embodiments, a bladder of flexible material can be placed between Fluid 1 and Fluid 2 to prevent excessive mixing.

The shape of the container 11 may be rectangular, oval, or some combination of curved and flat walls that can maximize the power of the seiche. The top of each intake valve 13*l*, 13*r* may be shaped to maximize the creation of a partial vacuum on the pump side as the reflected seiche passes back over.

Additional configurations are possible in other embodiments with the goal of establishing a beneficial microclimate in the shaped container. For example, the reflective walls 18*l*, 18*r* can be shaped to direct oncoming energy in the form of a fluid wave (the seiche) at an angle other than 180 degrees. For example, the wave can be reflected to either side at an angle of 60 degrees and, after traveling a specified distance, encounter another reflective wall or an intake valve of another vertical column filled with Fluid 2 at the top and a mostly non-compressible fluid on the bottom. This additional column may be connected by piping to the original two vertical columns 12*l*, 12*r* and to the main turbine 17*m*. Alternatively, in other embodiments, the additional column may be connected to zero, one, or more vertical columns with or without turbine-driving piping mechanisms.

Reflecting the fluid wave at an angle other than 180 degrees may establish a continuous rotational motion for the fluid wave. Coupled with a specifically shaped container, such as a covered circular or oval bowl, and coupled with the opening and closing of side wall and ceiling ports of the container, a timing sequence can be established to maximize the use of "free energy" derived from the constant atmospheric pressure that is present outside and above the container.

In some embodiments of the disclosure, Fluid 1, Fluid 2, and Fluid 3 may be fluids of different densities. In other embodiments of the disclosure, Fluid 1 and Fluid 2 may be gases of different densities, where at least Fluid 2 is denser than air, and Fluid 3 is be a liquid, such as water. In other embodiments, Fluid 1 and Fluid 2 may be gases with essentially the same density. In still other embodiments, Fluid 1, Fluid 2, and Fluid 3 may be liquids of different densities. In other embodiments, Fluid 1 and Fluid 2 are liquids that are immiscible and incompressible.

While the present disclosure has been described in detail with reference to exemplary embodiments, those skilled in the art will appreciate that various modifications and substitutions can be made thereto without departing from the spirit and scope of the disclosure as set forth in the appended claims.

What is claimed is:

1. A method of operating a pumping apparatus, comprising the steps of:

pumping a first fluid from a top of a left column through an open right intake valve into a container, and opening lower gates of a connecting pipe that connects the left column to a right column, wherein a vacuum is created in the left column that pulls up a third fluid in the left column, which flows across lower turbine blades of a main turbine in the connecting pipe;

stopping pumping in the left column, closing the right intake valve and the lower gates, wherein the first fluid in the container moves toward a right reflective wall of the container;

pumping the first fluid from a top of the right column toward an open left intake valve and opening and upper gates of the connecting pipe, wherein a vacuum is created in the right column that puils up the third fluid, and the third fluid flows across upper turbine blades of the main turbine;

stopping pumping in the right column, closing left intake valve and the upper gates, wherein the first fluid in the container moves toward the left reflective wall of the container; and pumping the first fluid from the top of the left column toward the open right intake valve and opening the lower gates, wherein a vacuum is created in the left column that pulls up the third fluid, and the third fluid flows across lower turbine blades of the main turbine.

* * * * *